United States Patent [19]

Reinert

[11] Patent Number: 5,057,562

[45] Date of Patent: Oct. 15, 1991

[54] PROCESS FOR THE PHOTOCHEMICAL STABILIZATION OF UNDYED AND DYED POLYPROPYLENE FIBRES

[75] Inventor: Gerhard Reinert, Allschwil, Switzerland

[73] Assignee: Ciba-Geigy Corporation, Ardsley, N.Y.

[21] Appl. No.: 363,649

[22] Filed: Jun. 8, 1989

[30] Foreign Application Priority Data

Jun. 14, 1988 [CH] Switzerland ..... 2274/88

[51] Int. Cl.[5] ..... C08K 5/34; C08K 5/32; D02G 3/00; B32B 15/00

[52] U.S. Cl. ..... 524/87; 524/91; 524/99; 524/100; 524/102; 524/103; 8/442; 8/490; 428/375; 428/394

[58] Field of Search ..... 524/99, 102, 103, 87, 524/91, 100; 526/217, 222, 242; 428/375, 394; 8/442, 490

[56] References Cited

U.S. PATENT DOCUMENTS

| | | | |
|---|---|---|---|
| 2,343,094 | 2/1944 | Smith | 428/375 |
| 3,542,729 | 11/1970 | Murayama et al. | 524/103 |
| 3,640,928 | 2/1972 | Murayama . | |
| 3,738,803 | 6/1973 | Blanc | 8/490 |
| 3,790,525 | 2/1974 | Murayama et al. | 524/99 |
| 3,840,494 | 10/1974 | Murayama . | |
| 3,904,581 | 9/1975 | Murayama et al. | 524/103 |
| 4,021,432 | 5/1977 | Holt et al. | 524/102 |
| 4,064,102 | 12/1977 | Hillard et al. | 524/102 |
| 4,166,803 | 9/1979 | Irick | 252/402 |
| 4,191,683 | 3/1980 | Brunetti | 106/124 |
| 4,221,701 | 9/1980 | Rasberger | 524/102 |
| 4,537,923 | 8/1985 | Slongo | 524/100 |
| 4,764,176 | 8/1988 | Sakamoto | 8/442 |
| 4,770,667 | 9/1988 | Evans et al. | 8/490 |
| 4,775,386 | 10/1988 | Reinert et al. | 8/442 |
| 4,780,494 | 10/1988 | Hess | 524/99 |
| 4,804,699 | 2/1989 | Nelson et al. | 524/103 |
| 4,812,139 | 3/1989 | Brodmann | 8/442 |
| 4,831,068 | 5/1989 | Reinert et al. | 8/490 |
| 4,898,596 | 2/1990 | Riggins et al. | 8/490 |
| 4,965,301 | 10/1990 | Leininger | 8/490 |

FOREIGN PATENT DOCUMENTS

| | | |
|---|---|---|
| 0243319 | 4/1987 | European Pat. Off. . |
| 2453146 | 5/1976 | Fed. Rep. of Germany . |

OTHER PUBLICATIONS

A. K. Sarkar, Fluorescent Whitening Agents, Merrow Publishing Co. Ltd., Watford, England, (1971) pp. 71–72.

European Search Report.

F. K. Meyer et al. pp. 840–847 Dec. 1985 Aktuene Tendenzen Beider Slabilisierung von Polypropylen–Fasern.

F. Steinlin et al. pp. 941–945 Nov. 1980 Influence of Pigments on the Degradation of Polypropylene Fasern.

*Primary Examiner*—Kriellion Morgan

*Attorney, Agent, or Firm*—George R. Dohmann; Edward McC.Roberts

[57] ABSTRACT

A process is disclosed for the photochemical stabilization of undyed and dyed polypropylene fibre material with light stabilizers, which process comprises treating said material with an aqueous solution containing a light stabilizer from the class of the sterically hindered amines.

9 Claims, No Drawings

PROCESS FOR THE PHOTOCHEMICAL STABILIZATION OF UNDYED AND DYED POLYPROPYLENE FIBRES

The present invention relates to a process for the photochemical stabilisation of undyed and dyed polypropylene fibres.

It is already known that it is not possible to use polypropylene fibres without the use of stabilisers and that such stabilisers, for example antioxidants and light stabilisers, are incorporated in the spinning dope [q.v. for example Chemiefasern/Textilindustrie, 35, 840–847 (1985) and Melliand Textilberichte 11, 941–945 (1980)].

It has now been found that undyed and dyed polypropylene fibres can be stabilised from aqueous liquors.

The process of this invention comprises treating undyed or dyed polypropylene fibre material with an aqueous solution which contains a light stabiliser from the class of the sterically hindered amines.

The preferred light stabiliser for use in the process of this invention is a sterically hindered amine which contains in the molecule at least one group of formula I

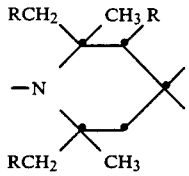

(I)

wherein R is hydrogen or methyl.

Such light stabilisers may be of low molecular weight (<700) or of high molecular weight (oligomers, polymers). These groups preferably carry one or two polar substituents in 4-position or a polar spiro ring system is in 4-position.

Particularly interesting sterically hindered amines are those of formula II

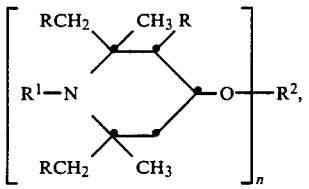

(II)

wherein n is an integer from 1 to 4, preferably 1 or 2, R is hydrogen or methyl, $R^1$ is hydrogen, hydroxy, $C_1$–$C_{12}$alkyl, $C_3$–$C_8$alkenyl, $C_3$–$C_8$alkynyl, $C_7$–$C_{12}$aralkyl, $C_1$–$C_8$alkanoyl, $C_3$–$C_5$alkenoyl, glycidyl —O—$C_1$–$C_{12}$-alkyl, —O-$C_1$–$C_8$-alkanoyl or a —$CH_2CH(OH)$—Z group in which Z is hydrogen, methyl or phenyl, $R^1$ preferably being hydrogen $C_1$–$C_4$alkyl, allyl, benzyl, acetyl or acryloyl, and $R^2$, when n is 1, is hydrogen, $C_1$–$C_{18}$alkyl which may be interrupted by one or more oxygen atoms, or is cyanoethyl, benzyl, glycidyl, a monovalent radical of an aliphatic, cycloaliphatic, araliphatic, unsaturated or aromatic carboxylic acid, carbamic acid or phosphorus-containing acid or is a monovalent silyl radical, preferably a radical of an aliphatic carboxylic acid of 2 to 18 carbon atoms, of a cycloaliphatic carboxylic acid of 7 to 15 carbon atoms, of an $\alpha,\beta$-unsaturated carboxylic acid of 3 to 5 carbon atoms or of an aromatic carboxylic acid of 7 to 15 carbon atoms, or, when n is 2, is $C_1$–$C_{12}$-alkylene, $C_4$–$C_{12}$alkenylene, xylylene, a divalent radical of an aliphatic, cycloaliphatic, araliphatic or aromatic dicarboxylic acid, dicarbamic acid or phosphorus-containing acid or is a divalent silyl radical, preferably a radical of an aliphatic dicarboxylic acid of 2 to 36 carbon atoms, of a cycloaliphatic or aromatic dicarboxylic acid of 8 to 14 carbon atoms or of an aliphatic, cycloaliphatic or aromatic dicarbamic acid of 8 to 14 carbon atoms, or, when n is 3, is a trivalent radical of an aliphatic, cycloaliphatic or aromatic tricarboxylic acid, of an aromatic tricarbamic acid or of a phosphorus-containing acid or is a trivalent silyl radical, or, when n is 4, is a tetravalent radical of an aliphatic, cycloaliphatic or aromatic tetracarboxylic acid.

Substituents defined as $C_1$–$C_{12}$alkyl are, for example, methyl, ethyl, n-propyl, n-butyl, sec-butyl, tert-butyl, n-hexyl, n-octyl, 2-ethylhexyl, n-nonyl, n-decyl, n-undecyl or n-dodecyl.

$R^1$ or $R^2$ as $C_1$-$C_{18}$alkyl may be, for example, one of the above mentioned groups and, in addition, may be n-tridecyl, n-tetradecyl, n-hexadecyl or n-octadecyl.

$R^1$ as $C_3$–$C_8$alkenyl may be, for example, 1-propenyl, allyl, methallyl, 2-butenyl, 2-pentenyl, 2-hexenyl, 2-octenyl or 4-tert-butyl-2-butenyl.

$R^1$ as $C_3$–$C_8$alkynyl is preferably propargyl.

$R^1$ as $C_7$–$C_{12}$ aralkyl is preferably phenethyl or, most preferably, benzyl.

$R^1$ as $C_1$–$C_8$alkanoyl is, for example, formyl, propionyl, butyryl, octanoyl, but is Preferably acetyl, and, as $C_3$–$C_5$-alkenoyl, $R^1$ is preferably acryloyl.

A monovalent radical $R^2$ of a carboxylic acid is, for example, a radical of acetic acid, caproic acid, stearic acid, acrylic acid, methacrylic acid, benzoic acid or $\beta$-(3,5-di-tert-butyl-4-hydroxyphenyl)propionic acid.

A divalent radical $R^2$ of a dicarboxylic acid is, for example, a radical of malonic acid, succinic acid, glutaric acid, adipic acid, suberic acid, sebacic acid, maleic acid, phthalic acid, dibutylmalonic acid, dibenzylmalonic acid, butyl-(3,5-di-tert-butyl-4-hydroxybenzyl)-malonic acid or bicycloheptenedicarboxylic acid.

A trivalent radical $R^2$ of a tricarboxylic acid, is for example, a radical of trimellitic acid or nitrilotriacetic acid.

A tetravalent radical $R^2$ of a tetracarboxylic acid is, for example, the tetravalent radical of butane-1,2,3,4-tetracarboxylic acid or of pyromellitic acid.

A divalent radical R of dicarbamic acid is, for example, a radical of hexamethylenedicarbamic acid or of 2,4-toluylenedicarbamic acid.

Examples of tetraalkylpiperidine compounds of this class are the following compounds:

1) 4-hydroxy-2,2,6,6-tetramethylpiperidine
2) 1-allyl-4-hydroxy-2,2,6,6-tetramethylpiperidine
3) 1-benzyl-4-hydroxy-2,2,6,6-tetramethylpiperidine
4) 1-(4-tert-butyl-2-butenyl)-4-hydroxy-2,2,6,6-tetramethylpiperidine
5) 4-stearoyloxy-2,2,6,6-tetramethylpiperidine
6) 1-ethyl-4-salicyloyloxy-2,2,6,6-tetramethylpiperidine
7) 4-methacryloyloxy-1,2,2,6,6-pentamethylpiperidine
8) 1,2,2,6,6-pentamethylpiperidin-4-yl-$\beta$-(3,5-di-tert-butyl-4-hydroxyphenyl)propionate
9)bis(1-benzyl-2,2,6,6-tetramethylpiperidin-4-yl) maleate
10) bis(2,2,6,6-tetramethylpiperidin-4-yl) succinate
11) bis(2,2,6,6-tetramethylpiperidin-4-yl) glutarate
12) bis(2,2,6,6-tetramethylpiperidin-4-yl) adipate
13) bis(2,2,6,6-tetramethylpiperidin-4-yl) sebacate 14) bis(1,2,2,6,6-pentamethylpiperidin-4-yl) sebacate
15) bis(1,2,3,6-tetramethyl-2,6-diethylpiperidin-4-yl) sebacate
16) bis(1-allyl-2,2,6,6-tetramethylpiperidin-4-yl) phthalate
17) 1-propargyl-4-β-cyanoethyloxy-2,2,6,6-tetramethylpiperidine
18) 1-acetyl-2,2,6,6-tetramethylpiperidin-4-yl acetate
19) tris(2,2,6,6-tetramethylpiperidin-4-yl) trimellitate
20) 1-acryloyl-4-benzyloxy-2,2,6,6-tetramethylpiperidine
21) bis(2,2,6,6-tetramethylpiperidin-4-yl) diethyl malonate
22) bis(1,2,2,6,6-pentamethylpiperidin-4-yl) dibutyl malonate
23) bis(1,2,2,6,6-pentamethylpiperidin-4-yl)butyl-(3,5-di-tert-butyl-4hydroxybenzyl)malonate
24) bis(1,2,2,6,6-pentamethylpiperidin-4-yl) dibenzyl malonate
25) bis(1,2,3,6-tetramethyl-2,6-diethylpiperidin-4-yl) dibenzyl malonate
26) hexane-1',6'-bis(4-carbamoyloxy-1-n-butyl-2,2,6,6-tetramethylpiperidine)
27) toluene-2',4'-bis(4-carbamoyloxy-1-n-propyl-2,2,6,6-tetramethylpiperidine)
28) dimethyl bis(2,2,6,6-tetramethylpiperidin-4-oxy)silane
29) phenyl tris(2,2,6,6-tetramethylpiperidin-4-oxy)silane
30) tris(1-propyl-2,2,6,6-tetramethylpiperidin-4-yl)phosphite
31) tris(1-propyl-2,2,6,6-tetramethylpiperidin-4-yl)phosphate
32) phenyl[bis(1,2,2,6,6-pentamethylpiperidin-4-yl)]-phosphonate
33) 4-hydroxy-1,2,2,6,6-pentamethylpiperidine
34) 4-hydroxy-N-hydroxyethyl-2,2,6,6-tetramethylpiperidine
35) 4-hydroxy-N-(2-hydroxypropyl)-2,2,6,6-tetramethylpiperidine
36) 1-glycidyl-4-hydroxy-2,2,6,6-tetramethylpiperidine Compounds of formula (III)

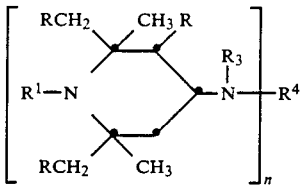

(III)

wherein n is 1 or 2, R and $R^1$ are as defined under formula (II), $R^3$ is hydrogen, $C_1$–$C_{12}$alkyl, $C_2$–$C_5$hydroxyalkyl, $C_5$–$C_7$cycloalkyl, $C_7$–$C_8$aralkyl, $C_2$–$C_{18}$alkanoyl, $C_3$–$C_5$alkenoyl or benzoyl, and $R^4$, when n is 1, is hydrogen, $C_1$–$C_{18}$alkyl, $C_3$–$C_8$alkenyl, $C_5$–$C_7$cycloalkyl, $C_1$–$C_4$alkyl which is substituted by hydroxy, cyano, alkoxycarbonyl or carbamido, or is glycidyl, a group of formula —$CH_2$—CH(OH)—Z or of formula —CONH—Z, in which Z is hydrogen, methyl or phenyl, or, when n is 2, is $C_2$–$C_{12}$-alkylene, $C_6$–$C_{12}$arylene, xylylene, a —$CH_2$—CH(OH)—$CH_2$—group or a —$CH_2$—CH(OH)—$CH_2$—O—D—O—group, in which D is $C_2$–$C_{10}$alkylene, $C_6$–$C_{15}$arylene or $C_6$–$C_{12}$cycloalkylene, or, provided that $R^3$ is not alkanoyl, alkenoyl or benzoyl, $R^4$ may also be a divalent radical of an aliphatic, cycloaliphatic or aromatic dicarboxylic acid or dicarbamic acid or, in addition, is the group —CO—, or $R^3$ and $R^4$ together, when n is 1, are the divalent radical of an aliphatic, cycloaliphatic or aromatic 1,2- or 1,3-dicarboxylic acid.

Alkyl substituents of 1 to 12 or 1 to 18 carbon atoms are as previously defined under formula (II).

$C_5$–$C_7$Cycloalkyl is preferably cyclohexyl.

$R^3$ as $C_7$–$C_8$is aralkyl is preferably phenylethyl and, most preferably, benzyl. $R^3$ as $C_2$–$C_5$hydroxyalkyl is preferably 2-hydroxyethyl or 2-hydroxypropyl.

$R^3$ as $C_2$–$C_{18}$alkanoyl is, for example, propionyl, butyryl, octanoyl, dodecanoyl, hexadecanoyl, octadecanoyl, but is preferably acetyl, and, as $C_3$–$C_5$-alkenoyl, $R^3$ is preferably acryloyl.

$R^4$ as $C_2$–$C_8$alkenyl is, for example, allyl, methallyl, 2-butenyl, 2-pentenyl, 2-hexenyl or 2-octenyl.

$R^4$ as $C_1$–$C_4$alkyl which is substituted by hydroxy, cyano, alkoxycarbonyl or carbamido group may be, for example, 2-hydroxyethyl, 2-hydroxypropyl, 2-cyanoethyl, methoxycarbonylmethyl, 2-ethoxycarbonylethyl, 2-aminocarbonylpropyl or 2-(dimethylaminocarbonyl-)ethyl.

$C_2$–$C_{12}$Alkylene is, for example, ethylene, propylene, 2,2-dimethylpropylene, tetramethylene, hexamethylene, octamethylene, decamethylene or dodecamethylene.

$C_6$–$C_{15}$Arylene is, for example, o-, m- or p-phenylene, 1,4-naphthylene or 4,4'-diphenylene.

A $C_6$–$C_{12}$cycloalkylene radical D is preferably cyclohexylene.

Examples of polyalkylpiperidine compounds of this class are the following compounds:

37) N,N'-bis(2,2,6,6-tetramethylpiperidin-4-yl)hexamethylene-1,6-diamine
38) N,N'-bis(2,2,6,6-tetramethylpiperidin-4-yl)hexamethylene-1,6-diacetamide
39) 1-acetyl-4-(N-cyclohexylacetamido)-2,2,6,6-tetramethylpiperidine
40) 4-benzoylamino-2,2,6,6-tetramethylpiperidine
41) N,N'-bis(2,2,6,6-tetramethylpiperidin-4-yl)-N,N'-dibutyladipamide
42) N,N'-bis(2,2,6,6-tetramethylpiperidin-4-yl)-N,N'-dicyclohexyl-2-hydroxypropylene-1,3-diamine
43) N,N'-bis(2,2,6,6-tetramethylpiperidin-4-yl)-p-xylylenediamine
44) N,N'-bis(2,2,6,6-tetramethylpiperidin-4-yl)succindiamide
45) bis(2,2,6,6-tetramethylpiperidin-4-yl)-N-(2,2,6,6-tetramethylpiperidin-4-yl)-β-aminodipropionate
46) the compound of formula

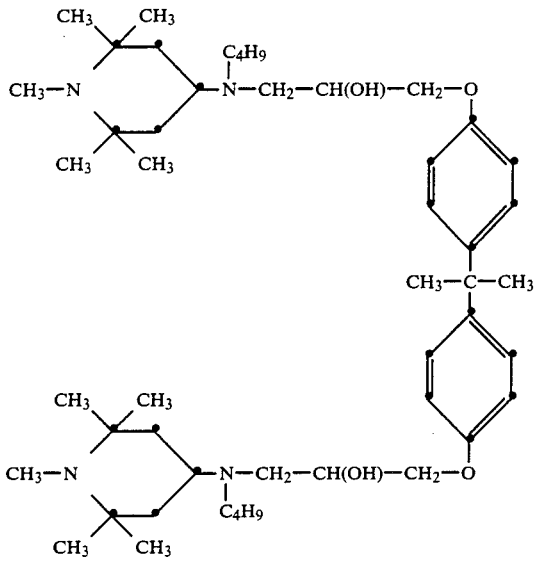

47) 4-(bis-2-hydroxyethylamino)-1,2,2,6,6-pentamethylpiperidine 48) 4-(3-methyl-4-hydroxy-5-tert-butylbenzamido)-2,2,6,6-tetramethylpiperidine and 49) 4-methacrylamido-1,2,2,6,6-pentamethylpiperidine.

Compounds containing at least one group of formula (I) are known and disclosed, for example, in U.S. patent specification No. 3 840 494, and can be prepared by the methods described therein.

The dyed polypropylene fibre material to be treated in the process of this invention is fibre material which may be coloured with an inorganic or organic pigment, or which is dyeable from the liquor. The pigment with which the material is coloured can be a white, black or coloured pigment. It can be a single pigment or a mixture of pigments.

Examples of inorganic pigments are titanium dioxide, zinc oxide, barium carbonate, carbon black, cadmium sulfide and cadmium selenide, chromates, chromium oxides, iron oxides or lead oxides.

Examples of organic pigments are those of the classes of azo pigments, anthraquinones, phthalocyanines, pyrrolopyrroles, quinacridones, isoindolines, or perylene pigments.

The amount of pigment may vary within wide limits, and is preferably from 0.01 to 10% by weight, based on the polypropylene.

The undyed polypropylene fibre material can also be photochemically stabilised and simultaneously whitened by treating the fibre material with an aqueous light stabiliser formulation which additionally contains a fluorescent whitening agent.

The present invention also relates to this process for stabilising polypropylene fibres.

Fluorescent whitening agents suitable for the process of this invention are those of the class of the polycyclic oxazoles, coumarins, aryl triazoles, styryl stilbenes and naphthalimides listed in, for example, A. K. Sarkar, Fluorescent Whitening Agents, Merrow Publishing Co. Ltd., Watford, England, (1971), pages 71–72.

Fluorescent whitening agents of the benzoxazole type are especially suitable.

The amount of dispersed fluorescent whitening agent is from 0.01 to 0.5%, based on the weight of the fibre material.

The aqueous solutions suitable for use in the process of this invention contain the compounds of formulae I to III in an amount of 0.05 to 7.5% by weight, preferably 0.1 to 3% by weight and, most preferably, 0.1 to 2% by weight, based on the weight of the fibre material.

The process of this invention can be carried out with compositions which normally comprise a) 5 to 75% by weight of a light stabiliser selected from the class of the sterically hindered amines, b) 0 to 25% by weight of a fluorescent whitening agent selected from the class of the polycyclic oxazoles, coumarins, aryl triazoles, styryl stilbenes and naphthalimides, c) 3 to 25% by weight of a nonionic or anionic dispersant, and d) water to make up 100% by weight.

Suitable nonionic dispersants are adducts of alkylene oxide with alcohols or alkylphenols, e.g. adducts of alkylene oxide with aliphatic $C_4$–$C_{22}$-alcohols, which adducts are obtained by addition of up to 80 mol of ethylene oxide and/or propylene oxide. The alcohols may preferably contain 4 to 18 carbon atoms and be saturated, branched or straight chain. They may be used singly or in admixture with other alcohols. Branched chain alcohols are preferred.

The alcohols may be natural alcohols, for example myristyl alcohol, cetyl alcohol, stearyl alcohol, oleyl alcohol, arachidyl alcohol or behenyl alcohol, or synthetic alcohols, for example preferably butanol, 2-ethyl-1-hexanol, amyl alcohol, n-hexanol, and also triethyl hexanol, trimethylnonyl alcohol, or Alfols (registered trademark of the Continental Oil Company). Alfols are linear primary alcohols. The number after the name indicates the average number of carbon atoms contained by the alcohol. For example, Alfol (12–18) is a mixture of decyl, dodecyl, tetradecyl, hexadecyl and octadecyl alcohol. Further examples are Alfol (810), (1014), (12), (16), (18), (2022).

Preferred ethylene oxide/alcohol adducts may be illustrated by the formula $$R_3O(CH_2CH_2O)_sH \quad (1)$$

wherein $R_3$ is a saturated or unsaturated aliphatic hydrocarbon radical, preferably an alkyl or alkenyl radical, each of 8 to 18 carbon atoms, and s is an integer from 1 to 80, preferably from 1 to 30.

Suitable nonionic dispersants are adducts of ethylene oxide and/or 1,2-propylene oxide and an alkylphenol containing 4 to 12 carbon atoms in the alkyl moiety, which phenol may contain one or more alkyl substituents. Preferably these compounds have the formula

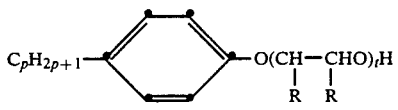

(2)

wherein R is hydrogen or not more than one of the two substituents R is methyl, p is an integer from 4 to 12, preferably 8 or 9, and t is an integer from 1 to 60, preferably from 1 to 20 and, most preferably, from 1 to 6.

If desired, these adducts of ethylene oxide/1,2-propylene oxide with an alcohol or alkylphenol may additionally contain small amounts of block polymers of the cited alkylene oxides.

Further adducts suitable for use as nonionic dispersants are polyoxyethylene derivatives of the fatty acid esters of sorbitan ethers with 4 mol of polyethylene glycol, e.g. the laurate, palmitate, stearate, tristearate, oleate and trioleate of the above ethers, e.g. the Tween products of the Atlas Chemicals Division. The tristearate of sorbitan ether with 4 mol of the polyethylene glycol of the formula $$H(CH_2CH_2)_{6\ 5}OH \quad (3)$$

is preferred.

Suitable anionic dispersants are esterified adducts of alkylene oxide, for example adducts of alkylene oxide, preferably of ethylene oxide and/or propylene oxide, with organic hydroxyl, carboxyl, amino and/or amido compounds containing aliphatic hydrocarbon radicals having a total of not less than 8 carbon atoms, or mixtures of such compounds, which adducts contain acid ester groups of an inorganic or organic acid. These acid esters may be in the form of the free acids or salts such as alkali metal salts, alkaline earth metal salts, ammonium salts or amine salts.

These anionic surfactants are obtained by known methods, by addition of at least 1 mol, preferably of more than 1 mol, e.g. 2 to 60 mol, of ethylene oxide or propylene oxide, or alternately, in any order, ethylene oxide and propylene oxide, to the above organic compounds, and subsequently esterifying the adducts, and, if desired, converting the esters into their salts. Suitable starting materials are for example higher fatty alcohols, i.e. alkanols or alkenols, each containing 8 to 22 carbon atoms, alicyclic alcohols, phenylphenols, alkylphenols containing one or more alkyl substituents which together contain at least 10 carbon atoms or fatty acids containing 8 to 22 carbon atoms.

Particularly suitable anionic dispersant are those of formula $$R_1-A-(CH_2\underset{\underset{R_2}{|}}{C}HO)_n-X \quad (4)$$

wherein $R_1$ is an aliphatic hydrocarbon radical containing 8 to 22 carbon atoms or a cycloaliphatic, aromatic or aliphatic-aromatic hydrocarbon radical containing 10 to 22 carbon atoms, $R_2$ is hydrogen or methyl, A is —O—or $$-\underset{\underset{O}{\|}}{C}-O-,$$

X is the acid radical of an inorganic oxygen-containing acid radical of a polybasic carboxylic acid or a carboxyalkyl radical, and n is an integer from 1 to 50.

The radical $R_1$-A in the compounds of formula (4) is derived e.g. from higher alcohols such as decyl, lauryl, tridecyl, myristyl, cetyl, stearyl, oleyl, arachidyl or behenyl alcohol; and from alicyclic alcohols such as hydroabietyl alcohol; from fatty acids such as caprylic, capric, lauric, myristic, palmitic, stearic, arachinic, behenic, $C_8$–$C_{18}$coconut fatty, decenoic, dodecenoic, tetradecenoic, hexadecenoic, oleic, linoleic, linolenic, eicosenoic, docosenoic or clupanodonic acid; from alkylphenols such as butylphenol, hexylphenol, n-octylphenol, n-nonylphenol, p-tert-octylphenol, p-tert-nonylphenol, decylphenol, dodecylphenol, tetradecylphenol or hexadecylphenol; or from arylphenols such as the o- or p-phenylphenols. Preferred radicals are those containing 10 to 18 carbon atoms, especially those which are derived from the alkylphenols.

The acid radical X is normally the acid radical of a polybasic, in particular low molecular, mono- or dicarboxylic acid, e.g. of maleic acid, malonic acid, succinic acid or sulfosuccinic acid, or it is a carboxyalkyl radical, in particular a carboxymethyl radical (derived in particular from chloroacetic acid), and is attached to the radical $R_1$-A-$(CH_2CHR_2O)_n$- through an ether or ester bridge. In particular, however, X is derived from an inorganic polybasic acid such as orthophosphoric acid and sulfuric acid. The acid radical X is preferably in salt form, i.e. for example in the form of an alkali metal salt, alkaline earth metal salt, ammonium or amine salt. Examples of such salts are sodium, calcium, ammonium, trimethylamine, ethanolamine, diethanolamine or triethanolamine salts. The alkylene oxide units $(CH_2CHR_2O)$ of formula (4) are normally ethylene oxide and 1,2-propylene oxide units. These last mentioned units are preferably in admixture with ethylene oxide units in the compounds of the formula (4).

Particularly interesting anionic compounds are those of formula $$R_3O-CH_2CH_2O)_nX \quad (5)$$

wherein $R_3$ is a saturated or unsaturated aliphatic hydrocarbon radical containing 8 to 22 carbon atoms, o-phenylphenyl or alkylphenol containing 4 to 12 carbon atoms in the alkyl moiety, and X and n have the given meanings.

Especially preferred compounds which are derived from adducts of alkylphenol and ethylene oxide are also those of formulae

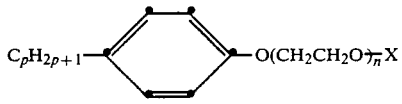

(6)

and

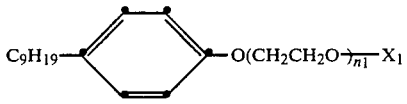

(7)

wherein p is an integer from 4 to 12, n is an integer from 1 to 20, n: is an integer from 1 to 10, $X_1$ is a sulfuric acid radical or a phosphoric acid radical which can be in salt form, and X has the given meaning.

The application of the sterically hindered amines can be made separately from that of the fluorescent whitening agent or, preferably, simultaneously with the application thereof, by an exhaust process at a liquor to goods ratio of 1:4 to 1:200, preferably 1:10 to 1:50, for example in a circulating dyeing machine or winch beck. They can, however, also be applied continuously by a low loading or hot application system, for example by a Fluidyer ® (supplied by Küsters), Flexnip ® (Küsters) or the like.

The liquor has a pH of 2 to 12, preferably 5 to 10 and, most preferably, 9.

The treatment liquors may further contain all chemicals suitable for the treatment of polypropylene material, for example electrolytes.

The invention is illustrated by the following Examples, in which parts and percentages are by weight.

EXAMPLE 1

Three 5 g hanks of polypropylene yarn of Nm 60/1 denier, for example Polycolon ®, in the colours white (sample A, dope-whitened), navy blue (sample B, dope-dyed) and dark blue (sample C, dope-dyed), are treated at a liquor to goods ratio of 1:30 in three liquors which contain the following ingredients:

1 g/l of calcined sodium carbonate, 0.5 g/l of a nonionic surfactant, and

1% by weight, based on the weight of the yarn, of the compound of formula (100)

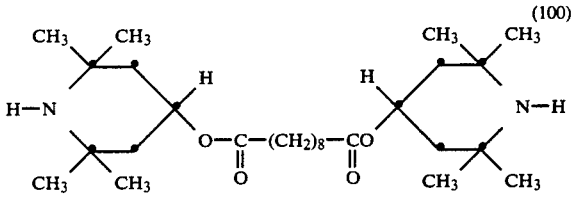

(100)

as 20% dispersion (ground in a sand mill) with the sulfonated condensate of naphthalene and formaldehyde as dispersant in the weight ratio of 1:1.

The yarns are put at 50° C. into the treatment bath (pH 10.3), which is heated over 15 minutes to 90° C. and kept at this temperature for 30 minutes. Finally, the goods are rinsed thoroughly with warm and cold water and subsequently dried at 60° C.

To determine the photochemical stability of the yarns A to C, ca. 25 strands of each are wound on to cardboard measuring 13×4.3 cm and subjected to heat exposure in accordance with DIN 75 202 (Draft 1/88) and with SN-ISO 105-B02 (xenon light test). After exposure, the tensile strength and the elongation of the individual yarns are determined in accordance with SNV 197 461, using the starting materials as standard and the exposed untreated yarns as references. The results are reported in Table 1.

TABLE I

| | Tensile strength/Elongation in (%) | | | | |
|---|---|---|---|---|---|
| | Untreated material | | | Post-stabilised material | |
| Sample | —*) | FAKRA 48h | FAKRA 144h | FAKRA 48h | FAKRA 144h |
| A | 100/100 | 83/78.9 | 68.8/53.7 | 99.1/93.3 | 89.2/80.6 |
| B | 100/100 | 38.2/35.3 | destroyed | 79.6/90.1 | 67.6/68.4 |
| C | 100/100 | 37.4/40.2 | destroyed | 100/89.0 | 75.2/64.0 |
| | Untreated material | | | Post-stabilised material | |
| Sample | —*) | xenon 500h | xenon 1000h | xenon 500h | xenon 1000h |
| A | 100/100 | 100/82 | 77/76 | 100/91 | 93/91 |
| B | 100/100 | 69/68 | destroyed | 89/100 | 88/93 |
| C | 100/100 | 62/66 | 17/23 | 84/87 | 87/86 |

*)standard

It is evident from the table that the light and heat stability of the white yarn have been markedly, and of the two dyed yarns substantially, enhanced.

EXAMPLE 2

The procedure described in Example 1 is repeated, using in place of the compound of formula (100) the compound of formula (200)

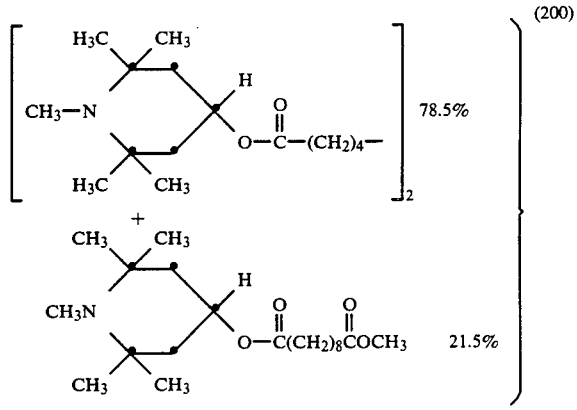

(200)

in an amount of 1% by weight, based on the weight of the yarn, as a 50% emulsion (50 parts of compound (200), 35 parts of white spirit and 15 parts of a nonionic surfactant). Sample D is white yarn (dope-whitened), and samples E and F are, respectively, navy blue and dark blue dope-dyings.

The results are reported in Table II

TABLE II

| | Tensile strength/Elongation in (%) | | | | |
|---|---|---|---|---|---|
| | Untreated material | | | Post-stabilised material | |
| Sample | —*) | FAKRA 48h | FAKRA 144h | FAKRA 48h | FAKRA 144h |
| D | 100/100 | 83/78.9 | 68.8/53.7 | 96.6/97.6 | 96.2/87.9 |
| E | 100/100 | 38.2/35.3 | destroyed | 79.2/85.5 | 72.7/70.1 |
| F | 100/100 | 37.4/40.2 | destroyed | 100/100 | 71.4/61.6 |
| | Untreated material | | | Post-stabilised material | |
| Sample | —*) | xenon 500h | xenon 1000h | xenon 500h | xenon 1000h |
| D | 100/100 | 100/82 | 77/76 | 88/94 | 89/95 |
| E | 100/100 | 69/68 | destroyed | 100/93 | 95/85 |
| F | 100/100 | 62/66 | 17/23 | 92/100 | 84/96 |

*)standard

When using compound (200) also, a good to very good post-stabilisation against light- and heat-induced degradation of the fibres was achieved in the treatment of all three samples.

EXAMPLE 3

Two 10 g samples of Maraklon® staple fabric (unstabilised polypropylene) are respectively whitened and simultaneously whitened and stabilised. Sample 1 is treated in a liquor of the following composition:

1 g/l of sodium carbonate, 0.5 g/l of a nonionic surfactant, and 0.1% by weight, based on the weight of the fabric, of the compound of formula

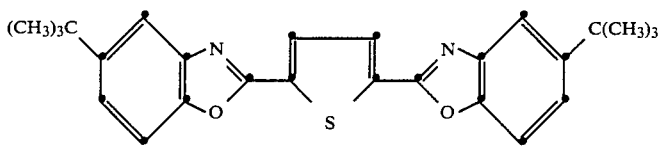

(300)

as 20% dispersion (ground in a sand mill) with the sulfonated condensate of naphthalene and formaldehyde as dispersant in the weight ratio of 2:1.

Sample II is treated in a liquor which additionally contains 1% by weight, based on the weight of the fabric, of compound (100) as 20% formulation.

The treatment is carried out as described in Example 1.

Both samples are whitened to a good degree of whiteness. After subjecting samples I and II to exposure, for example in accordance with DIN 75 202 (Draft 1/88), an exposure time of only 2 hours suffices to destroy sample I completely. In contrast, stabilised sample II is still intact after an exposure time of 144 hours and has high tensile strength.

EXAMPLE 4

Two 10 g samples of Maraklon® staple fabric (unstabilised polypropylene) are respectively bleached and simultaneously whitened and stabilised by treating them at 50° C. at a liquor to goods ratio of 1:25 in two bleaching baths, each containing 2 g/l of 80% sodium chlorite, 2 g/l of sodium nitrate, 1.5 ml/l of 85% formic acid, and 0.5 g/l of a nonionic sufactant, while the second bath additionally contains 0.1% by weight, based on the weight of the fabric, of the fluorescent whitening agent of formula (300) (as 20% dispersion). The bleaching baths are heated over 30 minutes to 85° C. and treatment is carried out for 60 minutes at this temperature. The baths are then cooled and the substrates are rinsed twice with cold water, centrifuged and dried.

The two samples are then halved. Parts (a) are not further treated, but parts (b) are treated at a liquor to goods ratio of 1:25 in a bath containing 0.5 g/l of a nonionic surfactant, 0.5 g/l of calcined sodium carbonate, and 1% by weight, based on the weight of the fabric, of the compound of formula (100) as 20% dispersion.

The bath is heated to 50° C., the temperature is raised over 10 minutes to 75° C., and treatment is carried out for 30 minutes at this temperature. The bath is then cooled and the substrates are rinsed with cold water and dried.

Both samples are whitened to a very good degree of whiteness. When samples 1a, 1b, 2a and 2b are subjected to exposure for 350 hours in accordance with SN-ISO 105-B02 (xenon lamp test) and for 72 hours in accordance with DIN 75 202 (Draft 1/88); Fakra test), the mechanical strength of samples 1a and 2a is poor and nil respectively, whereas that of samples of 1b and 2b is good.

EXAMPLE 5

The procedure of Example 4 is repeated, using in place of compound (100) 1% by weight, based on the weight of the fabric, of compound (200) as 50% emulsion.

In this treatment too, the 4 samples are whitened to a high degree of whiteness. The whitened samples la and 2a also have only poor stability to light and heat, whereas samples 1b and 2b withstand without deterioration a 72 hour exposure in accordance with DIN 75 202 (Draft 1/88).

EXAMPLES 6-8

The procedure as described in Example 4 is repeated, using as fluorescent whitening agent the compound of formula

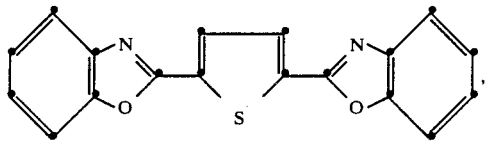

(400)

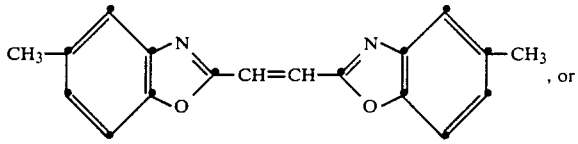

(401)

-continued

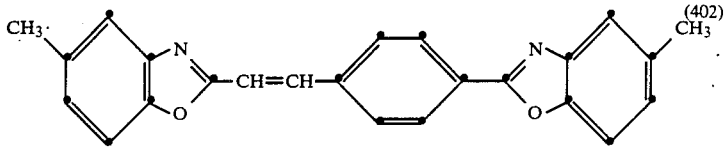

(402)

The fabric samples are whitened to a degree of whiteness comparable to that obtained in Example 4. However, the whitened fabric is not stable to light until after stabilisation has been effected with the compound of formula (200), i.e. is still mechanically stable after exposure.

EXAMPLES 9-11

Three 10 g samples of Maraklon ® fabric are treated at a liquor to goods ratio of 1:20 in a bath which contains 0.5 g/l of a nonionic surfactant, 1.0 g/l of ammonium sulfate, and 1% of the following compounds (as formulations):

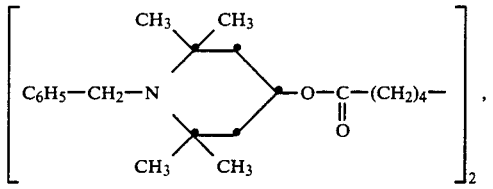

(403)

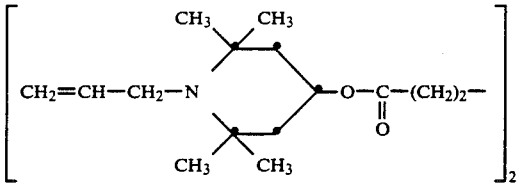

(404) or

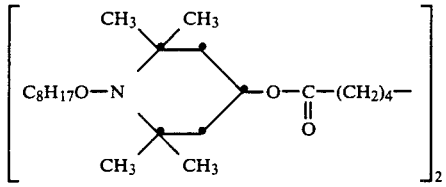

(405)

[Compounds (403) and (404) are in the form of 20% dispersions, whereas compound (405) is in the form of an emulsifiable liquid formulation as described for compound (200)].

The fabric is put into a dyeing machine (for example an AHIBA ® machine) at 50° C., the temperature is raised over 30 minutes to 90° C., and treatment is carried out for 30 minutes at this temperature. The bath is then cooled to 60° C. and the treated fabric is rinsed with warm and cold water and dried.

After the starting material and the treated samples have been subjected for 144 hours to the hot light exposure test in accordance with DIN 75 202 (Fakra Test), the treated fabric is still intact, whereas the untreated fabric decomposes on contact.

I claim:

1. A process for the photochemical stabilization of undyed and dyed polypropylene fibers with light stabilizers, which comprises applying an aqueous solution containing a light stabilizer from the class of stearically hindered amines onto the polypropylene fibers by means of a bath.

2. A process according to claim 1, wherein the light stabiliser is a sterically hindered amine which contains in the molecule at least one group of formula I

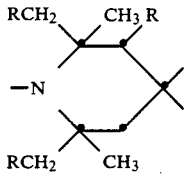

(I)

wherein R is hydrogen or methyl.

3. A process according to claim 2, wherein the light stabiliser is a sterically hindered amine of formula II

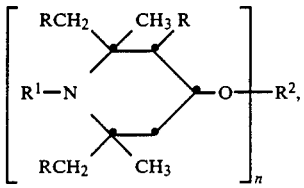

(II)

wherein n is an integer from 1 to 4, R is hydrogen or methyl, $R^1$ is hydrogen, hydroxy, $C_1$-$C_{12}$alkyl, $C_3$-$C_8$alkenyl, $C_3$-$C_8$alkynyl, $C_7$-$C_{12}$aralkyl, $C_1$-$C_8$alkanoyl, $C_3$-$C_5$alkenoyl, glycidyl —O—$C_1$-$C_{12}$-alkyl, —O—$C_1$-$C_8$-alkanoyl or a —$CH_2CH(OH)$—Z group in which Z is hydrogen, methyl or phenyl, and $R^2$, when n is 1, is hydrogen, $C_1$-$C_{18}$alkyl which may be interrupted by one or more oxygen atoms, or is cyanoethyl, benzyl, glycidyl, a monovalent radical of an aliphatic, cycloaliphatic, araliphatic, unsaturated or aromatic carboxylic acid, carbamic acid or phosphorus-containing acid or is a monovalent silyl radical, or, when n is 2, is $C_1$-$C_{12}$-alkylene, $C_4$-$C_{12}$alkenylene, xylylene, a divalent radical of an aliphatic, cycloaliphatic, araliphatic or aromatic dicarboxylic acid, dicarbamic acid or phosphorus-containing acid or is a divalent silyl radical, or, when n is 3, is a trivalent radical of an aliphatic, cycloaliphatic or aromatic tricarboxylic acid, of an aromatic tricarbamic acid or of a phosphorus-containing acid or is a trivalent silyl radical, or, when n is 4, is a tetravalent radical of an aliphatic, cycloaliphatic or aromatic tetracarboxylic acid.

4. A process according to claim 2, wherein the light stabiliser is a sterically hindered amine of formula III (III)

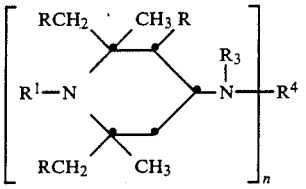

wherein n is 1 or 2, R and $R^1$ are as defined under formula (II), $R^3$ is hydrogen, $C_1$–$C_{12}$alkyl, $C_2$–$C_5$hydroxyalkyl, $C_5$–$C_7$cycloalkyl, $C_7$–$C_8$aralkyl, $C_2$–$C_{18}$alkanoyl, $C_3$–$C_5$alkenoyl or benzoyl, and $R^4$, when n is 1, is hydrogen, $C_1$–$C_{18}$alkyl, $C_3$–$C_8$alkenyl, $C_5$–$C_7$cycloalkyl, $C_1$–$C_4$alkyl which is substituted by hydroxy, cyano, alkoxycarbonyl or carbamido, or is glycidyl, a group of formula —$CH_2$—CH(OH)—Z or of formula —CONH—Z, in which Z is hydrogen, methyl or phenyl, or, when n is 2, is $C_2$–$C_{12}$-alkylene, $C_6$–$C_{12}$arylene, xylylene, a —$CH_2$—CH(OH)—$CH_2$—group or a —$CH_2$—CH(OH)—$CH_2$—O—D—O—group, in which D is $C_2$–$C_{10}$alkylene, $C_6$–$C_{15}$arylene or $C_6$–$C_{12}$cycloalkylene, or, provided that $R^3$ is not alkanoyl, alkenoyl or benzoyl, $R^4$ may also be a divalent radical of an aliphatic, cycloaliphatic or aromatic dicarboxylic acid or dicarbamic acid or, in addition, is the group —CO—, or $R^3$ and $R^4$ together, when n is 1, are the divalent radical of an aliphatic, cycloaliphatic or aromatic 1,2- or 1,3-dicarboxylic acid.

5. A process according to claim 3, wherein the sterically hindered amine is a compound of the formula as defined in claim 3, wherein n is 1 or 2, R is hydrogen, $R^1$ is hydrogen or $C_1$–$C_4$alkyl, and $R^2$, when n is 1, is a monovalent radical of an aliphatic carboxylic acid of 8 to 10 carbon atoms or, when n is 2, is a divalent radical of an aliphatic dicarboxylic acid of 6 to 10 carbon atoms.

6. A process according to claim 3, which comprises applying a mixture of compounds of the formula as defined in claim 3, wherein n is 1 and 2.

7. A process according to claim 1, which comprises treating the undyed polypropylene fibre material with an aqueous light stabiliser formulation which additionally contains a fluorescent whitening agent.

8. A process according to claim 1, wherein the process is carried out discontinuously by an exhaust process.

9. Polypropylene fibre material treated by a process as claimed in claim 1.

* * * * *